US006059395A

United States Patent [19]

Takata et al.

[11] Patent Number: 6,059,395

[45] Date of Patent: May 9, 2000

[54] INKJET RECORDING HEAD

[75] Inventors: Hasashi Takata, Takatsuki; Naoki Matsui, Sakai, both of Japan

[73] Assignee: Minolta Co., Ltd., Osaka, Japan

[21] Appl. No.: 09/012,136

[22] Filed: Jan. 22, 1998

[30] Foreign Application Priority Data

Jan. 22, 1997 [JP] Japan ..... 9-009295

[51] Int. Cl.[7] ..... B41J 2/205

[52] U.S. Cl. ..... 347/15; 347/65; 347/70

[58] Field of Search ..... 347/11, 15, 68, 347/70, 71, 72, 65, 94

[56] References Cited

U.S. PATENT DOCUMENTS

| | | | |
|---|---|---|---|
| 4,367,480 | 1/1983 | Kotoh | 346/140 R |
| 4,369,455 | 1/1983 | McConica et al. | 347/11 |
| 4,503,444 | 3/1985 | Tacklind | 347/15 |
| 4,546,362 | 10/1985 | Koto | 347/70 |
| 5,208,605 | 5/1993 | Drake | 347/15 |
| 5,412,410 | 5/1995 | Rezanka | 347/15 |
| 5,444,471 | 8/1995 | Usui et al. | 347/72 |
| 5,446,485 | 8/1995 | Usui et al. | 347/72 |
| 5,684,520 | 11/1997 | Morikoshi et al. | 347/70 |
| 5,793,393 | 8/1998 | Coven | 347/65 |
| 5,896,149 | 4/1999 | Kitahara et al. | 347/70 |

FOREIGN PATENT DOCUMENTS 0437062 7/1991 European Pat. Off. .

2282992 4/1995 United Kingdom .

*Primary Examiner*—John Barlow
*Assistant Examiner*—Juanita Stephens
*Attorney, Agent, or Firm*—Sidley & Austin

[57] ABSTRACT

A recording head comprises a first head member that expels large-diameter ink drops and a second head member that expels small-diameter ink drops. Each of the first head member and the second head member is integrally assembled with a top plate, a partition, a vibration plate and a substrate, which are stacked together one on top of the other. The top plate has multiple groove-shaped concave areas in its surface which faces the partition. Covering these concave areas with the partition forms ink cavities housing ink, ink supply chambers housing resupply ink, and ink inlets connecting the ink cavities to their respective ink supply chambers in first head member and second head member. In addition, nozzles connected to the ink cavities are formed in the side opposite from the ink inlets on the top plate. The cross-sectional areas of the ink inlets of the first head member perpendicular to the direction of ink flow are made smaller or the lengths of said ink inlets are made longer than those of the second head member in the direction of ink flow. In contrast, the configurations and sizes of the nozzles of the first and the second head members are identical, and their impedances are also the same. Therefore, the impedance ratio (ink inlet impedance divided by nozzle impedance) is larger for the first head member than for the second head member, but the values of impedance for both head members are set to be within a range of approximately 0.5 to 6.

18 Claims, 2 Drawing Sheets

INKJET RECORDING HEAD

This application is based on application No. 9-9295 filed in Japan, the contents of which are hereby incorporated by reference.

BACKGROUND OF THE INVENTION

1. Field of the Invention

The present invention pertains to an inkjet recording head that responds to an image signal by recording an image by affixing ink drops expelled from nozzles onto a recording medium such as recording paper.

2. Description of the Related Art

An image recording device using the inkjet method is generally equipped with an inkjet recording head that is equipped with ink cavities that are connected to ink expulsion nozzles and ink inlets used for supplying ink, as well as actuators that cause ink drops to be expelled from said nozzles by applying pressure to the ink inside said cavities.

In order to form high-quality images, some of the inkjet recording heads of this type are equipped with multiple nozzles having different sizes. In other words, ink drops having a large diameter are expelled by nozzles having a large diameter, while ink drops having a small diameter are expelled by nozzles having a small diameter, such that dots of different diameters are formed on the recording medium, improving image quality.

Incidentally, the ink in the ink cavities is pressurized and expelled from the nozzles by the actuators, thus instantly reducing the volume of the ink cavities. When this occurs, the ink of an amount equivalent to the amount by which said volume is reduced is divided into two components: the component that is expelled from the nozzle as an ink drop and the component that, flows backward via the ink inlet to the ink supply chamber that houses the ink used as resupply ink.

Therefore, when the impedance of the ink supply path changes due to the diameter, configuration, etc. of the nozzle, in some cases the ratio of said expelled ink component to the backward-flowing component fluctuates, and ink drops cannot be expelled in a stable fashion.

OBJECTS AND SUMMARY

In consideration of the situation described above, after observing the effect of changing the impedances of the ink inlets and nozzles on ink expulsion, the inventors of the present invention have discovered that if said impedances are not set within an appropriate range, ink expulsion becomes very unstable, which has a detrimental effect on image formation.

As a result, after reviewing experiment results with a focus on the ratio of ink inlet impedance to nozzle impedance (hereinafter referred to as the 'impedance ratio'), the inventors of the present invention have discovered the practically useful range for this impedance ratio to obtain stable ink expulsion.

The object of the present invention is to provide an inkjet recording head capable of stable expulsion of ink drops.

Another object of the present invention is to provide an inkjet recording head having the optimal ratio of ink inlet impedance to nozzle impedance.

In order to achieve these and other objects, an inkjet recording head of the embodiment comprising: a nozzle which expels ink; an ink cavity connected to said nozzle, which houses ink to be expelled from the nozzle; an ink inlet connected to said ink cavity to provide resupply ink to said ink cavity; and in actuator which pressurizes the ink inside said ink cavity and expels ink from said nozzle; wherein the ratio of the impedance of said ink inlet to the impedance of said nozzle is in the range of 0.5 to 6.

BRIEF DESCRIPTION OF THE DRAWINGS

These and other objects and features of the present invention will become apparent from the following description of a preferred embodiment thereof taken in conjunction with the accompanying drawings, in which.

In the following description, like parts are designated by like reference numbers throughout the several drawings.

DETAILED DESCRIPTION OF THE PREFERRED EMBODIMENT

An embodiment of the present invention will be described below with reference to the attached drawings.

Figure 1:
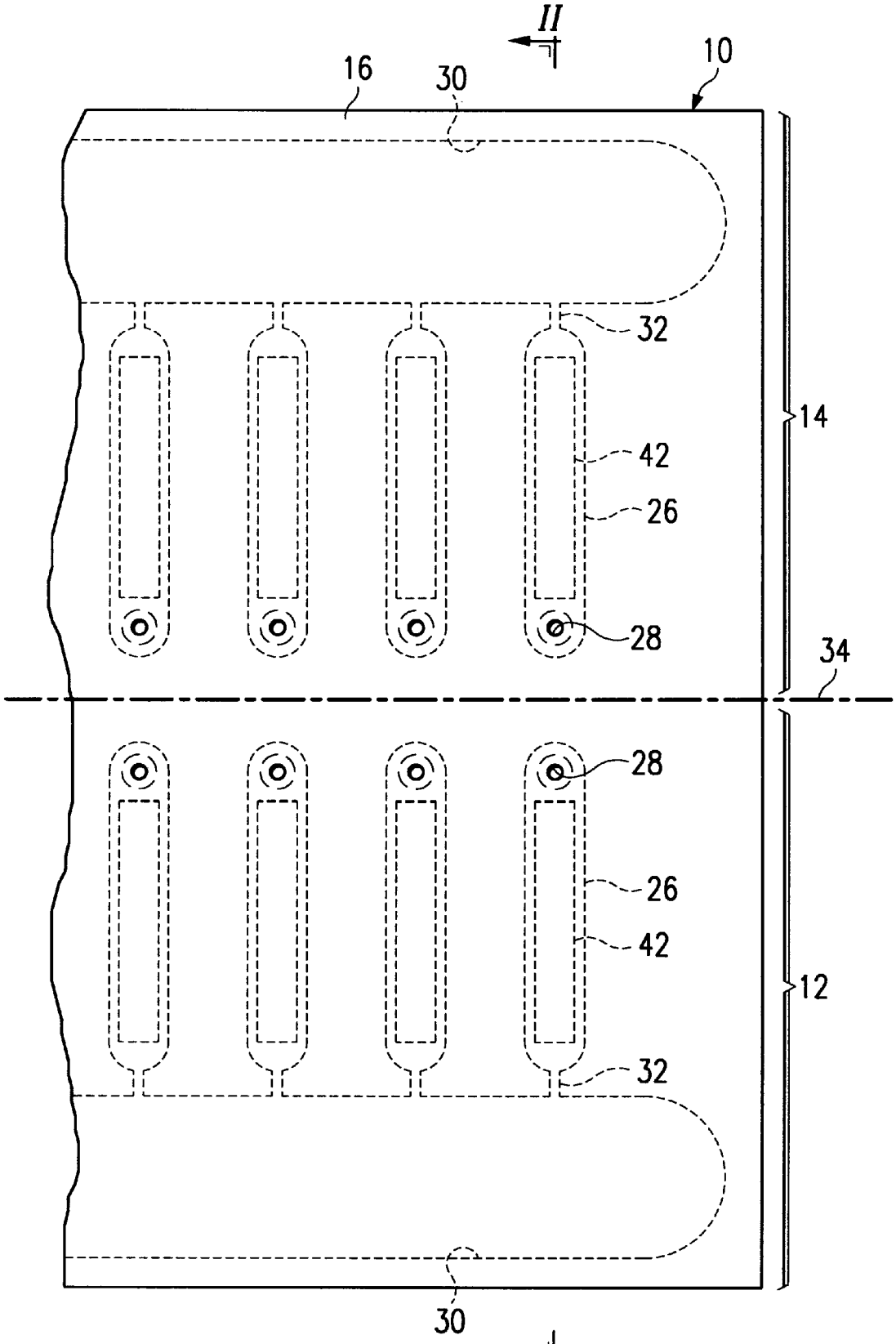
FIG. 1 is a partial plan view of an inkjet recording head in accordance with the present invention.
Figure 2:
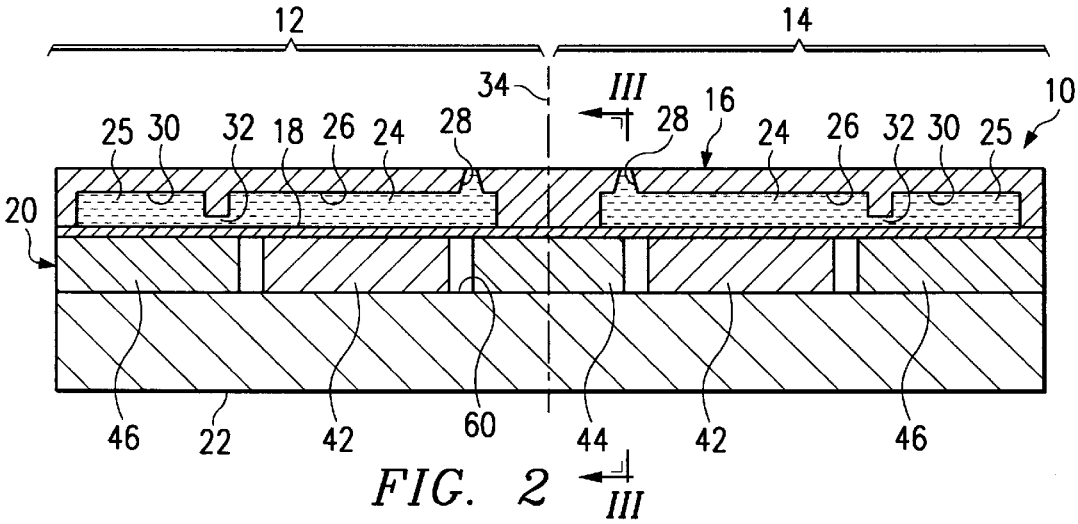
FIG. 2 is a cross-section of the inkjet recording head of FIG. 1 cut along the II—II line.
Figure 3:
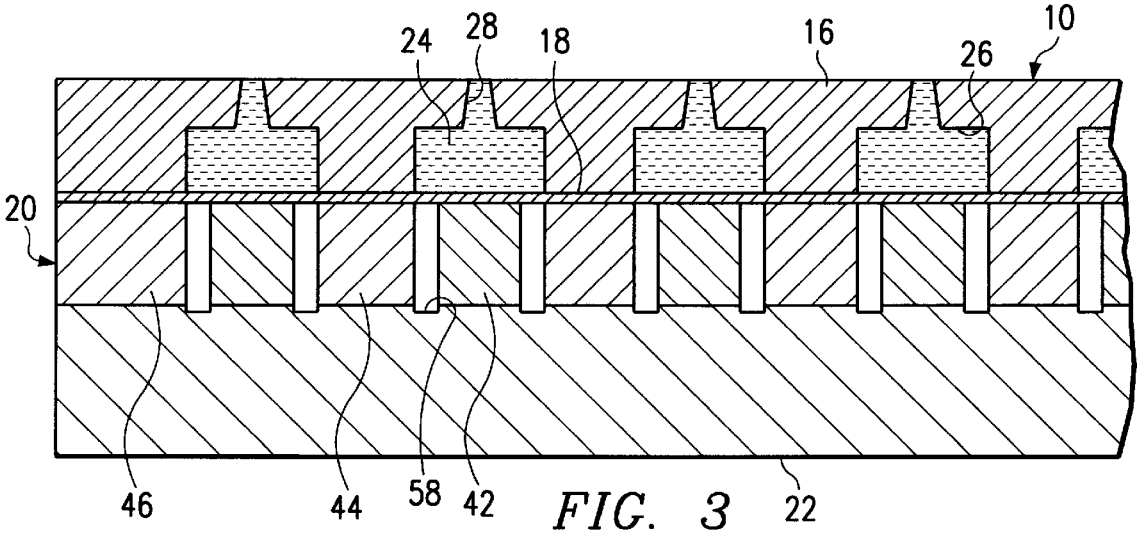
FIG. 3 is a cross-section of the inkjet recording head of FIG. 2 cut along the IV—IV line.

FIGS. 1 through 3 show an inkjet recording head 10 pertaining to the present invention. This recording head 10 comprises a first head member 12 that expels large-diameter ink drops and a second head member 14 that expels small-diameter ink drops. First head member 12 and second head member 14 are each integrally assembled with top plate 16, partition 18, vibration plate 20 and substrate 22, which are stacked together one on top of the other.

Top plate 16 is made of ceramic, synthetic resin or metal, and has in its surface facing partition 18 multiple groove-shaped concave areas formed via microprocessing using a method such as photolithography. Covering these concave areas of top plate 16 with partition 18 forms ink cavities 26 housing ink 24, ink supply chambers 30 housing resupply ink 25 (which is merely the housing ink 24 that is not expelled from nozzles 28 but instead returns to ink supply chambers 30), 24, and ink inlets 32 connecting ink cavities 26 to their respective ink supply chambers 30 in first head member 12 and second head member 14. In addition, nozzles 28 connected to ink cavities 26 are formed in the side opposite from ink inlets 32 on top plate 16 by means of a method such as excimer laser processing.

Each nozzle 28 is formed in the shape of a truncated cone whose ink drop expulsion end is smaller than its bottom close to ink cavity 26. Nozzles 28 in first head member 12 and second head member 14 are of the same shape and same size.

Nozzles 28 are not limited to the shape of a truncated cone, and it is also acceptable if they have a different configuration (such as a cylindrical configuration).

As shown in FIG. 1, ink cavities 26 of first head member 12 and second head member 14 are formed so as to extend in a groove-like configuration toward the line at which these heads members 12 and 14 face each other, as well as parallel to one another. Ink supply chambers 30 are formed on opposite sides of center line 34 sandwiching ink cavities 2G, and are each connected to an ink tank not shown in the drawing.

Ink inlets 32 are formed as paths having an interior configuration of a rectangular parallelepiped in both first head member 12 and second head member 14. The cross-sectional areas of ink inlets 32 of first head member 12 perpendicular to the direction of ink flow are made smaller or the lengths of said ink inlets 32 are made longer than those of second head member 14 in the direction of ink flow. Alternatively, by combining these designs, the impedance for ink inlets 32 of first head member 12 are made larger than that for ink inlets 32 of second head member 14. The configuration of ink inlets 32 is not limited to a rectangular parallelepiped, and another configuration (such as a triangular or cylindrical tube) may be used instead, or a tapered configuration (such as a cone) may be used.

In contrast, the configurations and sizes of nozzles 28 of head members 12 and 14 are identical, and their impedances are also the same, as described above. Therefore, the impedance ratio (ink inlet impedance divided by nozzle impedance) is larger for first head member 12 than for second head member 14, but the values of impedance for both head members are set to be within a range of approximately 0.5 to 6. For the reason described below, it is preferred to use an impedance ratio for first head member 12 that is near the upper limit of said range and to use an impedance ratio for second head member 14 that is near the lower limit of said range.

As shown in FIG. 2, partition 18 is made of a thin film comprising metal, synthetic resin, etc., and is fixed between top plate 16 and vibration plate 20. It is preferred for partition 18 to be fixed with a prescribed amount of tension being applied to it.

Vibration plate 20 is made of a public-domain piezoelectric material. Conductive metal layers (not shown in the drawings) are formed on its upper and lower surfaces by means of sputtering or some other method, said layers being used as common and individual electrodes, respectively. Vibration plate 20 is fixed between partition 18 and substrate 22.

As shown in FIGS. 2 and 3, vertical grooves 58 and horizontal grooves 60 are formed in vibration plate 20 by means of dicing. Vibration plate 20 is divided into piezoelectric members (actuators) 42 that face ink cavities 26 via partition 18, partition walls 44 between adjacent piezoelectric members 42, and surrounding wall 46 that surrounds them. Each piezoelectric member 42 is polarized by applying a high voltage between the common and individual electrodes on the top and bottom sides under high temperature. Piezoelectric members 42 need not comprise only a single layer, but piezoelectric members of a multi-layer type that are formed by stacking multiple thin piezoelectric sheets as if to sandwich the metal electrode layers may be used instead.

Substrate 22 is made of ceramic, metal, synthetic resin, etc., and is fixed to vibration plate 20.

In inkjet recording head 10 having the construction described above, ink 24 supplied to ink supply chamber 30 from an ink tank not shown in the drawings is supplied to ink cavities 26 via ink inlets 32. When voltage is impressed between the individual and common electrodes of piezoelectric member 42 by means of an image signal control circuit (not shown in the drawings), piezoelectric member 42 immediately deforms and pushes up partition 18, which reduces the volume of ink cavity 26 and pressurizes the ink inside it. When this occurs, the ink of an amount equivalent to the amount by which said volume is reduced is divided into two components: the component that is expelled from the nozzle 28 as an ink drop and the component (housing resupply ink 25) that flows backward via ink inlet 32 and returns to ink supply chamber 30.

Because the amount of housing ink 24 that is expelled from nozzle 28 increases in accordance with the impedance ratio, if the amount by which the volume of ink cavity 26 is reduced is identical for both first head member 12 and second head member 14, a large amount of ink, i.e., a large-diameter ink drop, is expelled from nozzle 28 of first head member 12, which has a large impedance ratio, and a small amount of ink, i.e., a small-diameter ink drop, is expelled from nozzle 28 of second head member 14, which has a small impedance ratio. A halftone image is recorded by affixing these ink drops onto a recording medium, thereby forming large and small dots.

Impedance Z is expressed by means of equation (1) below.

$$Z = \sqrt{r^2 + (1/\omega c - \omega m)^2} \tag{1}$$

r: flow path resistance c: acoustic capacitance (surface tension)

m: inertance

ω: angular velocity

Angular velocity ω is the angular velocity of the vibration of the ink that is filling the ink cavity, and is determined from the pressure of the liquid inside the ink cavity, nozzle side impedance $Z_n$ and inlet side impedance $Z_i$ described below. ω $Z_n$ and $Z_i$ are actually derived by means of numerical analysis.

Figure 4A:
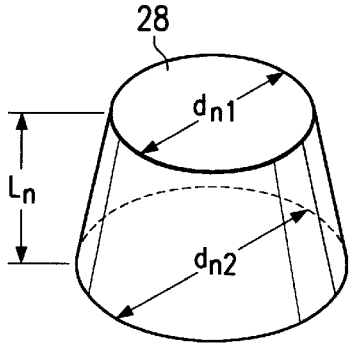
FIG. 4*a* is a drawing showing the configuration of the nozzles of the inkjet recording head of FIG. 1.
Figure 4B:
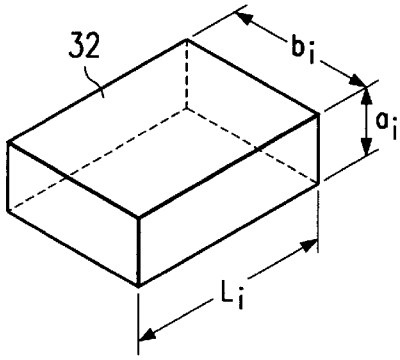
FIG. 4*b* is a drawing showing the configuration of the ink inlets of the inkjet recording head of FIG. 1.

When the dimensions of nozzles 28 and ink inlets 32 are defined as shown in FIGS. 4(*a*) and 4(*b*), the respective impedances for said nozzles 28 and ink inlets 32 may be sought by substituting the equations below using these dimensions in equation (1) above.

The symbol n below indicates the nozzle side, while i indicates the ink inlet side. ρ, η and σ indicate the density, viscosity and surface tension of the ink, respectively.

$$r_n = \frac{128\eta}{3\pi} \times \frac{l_n}{d_{n1} - d_{n2}} \times \left(\frac{1}{d_{n1}^3} - \frac{1}{d_{n2}^3}\right)$$

$$c_n = \frac{\pi d_{n1}^4}{96}$$

$$m_m = \frac{4\rho}{\pi} \times \frac{l_n}{d_{n1} - d_{n2}} \times \left(\frac{1}{d_{n1}} - \frac{1}{d_{n2}}\right)$$

$$r_i = \frac{8(a_i + b_i)^2}{a_i^3 b_i^3} \eta l_i$$

$$m_i = \frac{l_i}{a_i b_i} \rho$$

Note: Because $c_i$ is sufficiently large, it is not a concern.

Impedance ratio $Z_i/Z_n$ is determined from impedances $Z_n$ and $Z_i$ derived for nozzle 28 and ink inlet 32 from equation (1) above, but because, as described above, impedance $Z_n$ for nozzles 28 of first head member 12 and impedance $Z_n$ for nozzles 28 of second head member 14 are identical, the impedance ratios for head members 12 and 14 differ in response to a change in impedance $Z_i$ for ink inlets 32.

Therefore, an experiment was performed in which impedance $Z_i$ for ink inlets 32 was set at various levels and the effect of the changes in the impedance ratio on ink expulsion was observed. In this experiment, a voltage of 30 V was applied to piezoelectric members 42, and the reduction in capacity of ink cavity 26 caused by the resulting deformation of piezoelectric member 42 was 100 pl (picoliters). The results of the experiment are set forth in Table 1 below.

| Impedance Ratio | Backward-flow Ink Amount (pl) | Amount of Ink Expelled from Nozzle (pl) | Observation: Condition of expulsion | Observation: Remarks |
|---|---|---|---|---|
| Less than 0.5 | More than 66.7 | Less than 33.3 | Δ | Unstable |
| 0.5 | 66.7 | 33.3 | ○ | Good |
| 1 | 50.0 | 50.0 | ◎ | Excellent |
| 2 | 33.3 | 66.7 | ◎ | Excellent |
| ↓ | ↓ | ↓ | ◎ | Excellent |
| 5 | 16.7 | 83.3 | ◎ | Excellent |
| 6 | 14.3 | 85.7 | ○ | Good |
| More than 6 | Less than 14.3 | More than 85.7 | Δ | Unstable |

From the results of the experiment, it was found that the most useful impedance ratio for practical purposes was in the range between approximately 0.5 to 6, or more preferably, in the range between 1 and 5. If the impedance ratio is less than 0.5, an ink drop may not be expelled, and even if it is expelled, it comes out slowly, the ink may not create a nice round dot but may have a sprayed appearance, or tiny satellite dots may be formed in addition to the main dot. When the condition of expulsion becomes unstable in this way, the amount of housing resupply ink 25 that flows back to ink inlets 32 becomes more than twice the amount of housing ink 24 expelled from nozzles 28, which is unacceptably inefficient.

On the other hand, if the impedance ratio is more than 6, the amount of having resupply that flows back to ink inlets 32 decreases and the efficiency thus increases, but because of the increased impedance $Z_i$ for ink inlets 32, the supply of housing ink 24 from ink supply chamber 30 to ink cavities 26 becomes difficult, which results in variation in the ink expulsion amount from nozzles 28 when a drive voltage is repeatedly applied to piezoelectric members 42 in a short cycle, i.e., an unstable expulsion condition.

Where impedance $Z_i$ is increased by reducing the cross-sectional areas of ink inlets 32, the processing to create ink inlets 32 becomes difficult. In addition, fluctuation easily occurs due to increased effects of the differences in area between ink inlets 32 caused by uneven thickness of the adhesive layer, or by the adhesive material not staying in place when partition 18 is affixed, or due to processing errors.

As explained above, the impedance ratios for first head member 12 and second head member 14 of inkjet recording head 10 described above are set to be within the range of approximately 0.5 to 6. This impedance ratio range is a practically useful range in which stable ink expulsion conditions may be obtained. Therefore, using inkjet recording head 10 of this embodiment, large-diameter ink drops and small-diameter ink drops may be reliably expelled from head members 12 and 14, respectively, and high-quality halftone images may be recorded.

If the impedance ratio for first head member 12 is set to be near the upper limit of said range and that for second head member 14 is set to be near the lower limit of said range, the difference between the amounts of ink expelled from head member 12 and head member 14 may be increased, which is beneficial in increasing the available range of gradations.

The impedance ratios for first head member 12 and second head member 14 are made different, although both are within the range described above, by giving an identical impedance for nozzles 28 but different impedances for ink inlets 32. Therefore, head members 12 and 14 have an identical construction except for elements pertaining to ink inlets 32 (cross-sectional areas, for example), which permits easy manufacturing of head members that can expel ink drops of different sizes in a stable fashion.

While two head members having different impedance ratios, though both within the range described above, were used in this embodiment, it is also acceptable to use three or more head members that each expel ink drops of different sizes in order to increase the range of gradations. Further, if the voltage impressed to the piezoelectric members is changed in stages, the sizes of the ink drops expelled from the nozzles may be varied for each head member, which can further increase the available range of gradations.

The impedance ratios for head member 12 and head member 14 were made different from each other by giving them different impedances for ink inlets 32 in inkjet recording head 10 described above, but it is also acceptable if the impedance ratios are made different by having different impedances for the nozzles of the respective heads, or by changing the impedance ratios by changing both the ink inlets and the nozzles.

Further, piezoelectric members were used for the actuators that pressurize the ink inside ink cavities in this embodiment, but the present invention may also be applied in heads using the bubble jet method, in which heat-emitting elements are used for the actuators.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An inkjet recording head comprising:

a nozzle from which ink is expelled, said nozzle having an impedance;

an ink cavity connected to said nozzle to house ink to be expelled from said nozzle;

an ink inlet connected to said ink cavity to provide resupply ink to said ink cavity, said ink inlet having an impedance; and an actuator to pressurize the ink inside said ink cavity and to expel said pressurized ink from said nozzle;

wherein a ratio of the impedance of said ink inlet to the impedance of said nozzle is in a range from greater than 3.0 up to 6.0.

2. An inkjet recording head in accordance with claim 1, wherein said ratio of the impedance of said ink inlet to the impedance of said nozzle is in a range from greater than 3.0 up to 5.0.

3. An inkjet recording head comprising:

a first nozzle from which large ink droplets can be expelled, said first nozzle having an impedance;

a second nozzle from which small ink droplets can be expelled, said second nozzle having an impedance;

a first ink cavity connected to said first nozzle, a second ink cavity connected to said second nozzle, wherein said first and second ink cavities can respectively house ink to be expelled from said first and second nozzles respectively;

a first ink inlet having an impedance and being connected to said first ink cavity, a second ink inlet having an impedance and being connected to said second ink cavity, wherein said first and second ink inlets can respectively provide resupply ink to said first and second ink cavities respectively; and at least one actuator which can pressurize the ink inside said first and second ink cavities and can expel pressurized ink from said first and second nozzles;

wherein a first ratio of the impedance of said first ink inlet to the impedance of said first nozzle is greater than a second ratio of the impedance of said second ink inlet to the impedance of said second nozzle, and both of said first and second ratios are in a range from 0.5 to 6.0.

4. An inkjet recording head in accordance with claim 3, wherein both of said first and second ratios are in a range from 1.0 to 5.0.

5. An inkjet recording head in accordance with claim 3, wherein the impedance of said first nozzle is equal to the impedance of said second nozzle, and the impedance of said first ink inlet is greater than the impedance of said second ink inlet.

6. An inkjet recording head in accordance with claim 5, wherein each of said first and second ink inlets has a cross-sectional area perpendicular to a direction of ink flow, and wherein the cross-sectional area of said first ink inlet is smaller than the cross-sectional area of said second ink inlet.

7. An inkjet recording head in accordance with claim 5, wherein a length of said first ink inlet in a direction of ink flow is longer than a length of said second ink inlet in a direction of ink flow.

8. A recording method for use in an inkjet recording apparatus, the recording method comprising the steps of:

providing ink to an ink cavity through an ink inlet having an impedance;

pressurizing the ink inside said ink cavity; and expelling pressurized ink from said ink cavity through a nozzle having an impedance;

wherein a ratio of the impedance of said ink inlet to the impedance of said nozzle is in a range from greater than 3.0 up to 6.0.

9. A recording method in accordance with claim 8, wherein said ratio of the impedance of said ink inlet to the impedance of said nozzle is in a range from greater than 3.0 up to 5.0.

10. A recording method for use in an inkjet recording apparatus, the recording method comprising the steps of:

(a) when large dots are to be formed on a recording medium, providing ink to a first ink cavity through a first ink inlet having an impedance; pressurizing the ink inside said first ink cavity; and expelling pressurized ink from said first ink cavity through a first nozzle having an impedance; and (b) when small dots are to be formed on a recording medium, providing ink to a second ink cavity through a second ink inlet having an impedance; pressurizing the ink inside said second ink cavity; and expelling pressurized ink from said second ink cavity through a second nozzle having an impedance;

wherein a first ratio of the impedance of said first ink inlet to the impedance of said first nozzle is greater than a second ratio of the impedance of said second ink inlet to the impedance of said second nozzle, and both of said first and second ratios are in a range from 0.5 to 6.0.

11. A recording method in accordance with claim 10, wherein both of said first and second ratios are in a range from 1.0 to 5.0.

12. A recording method in accordance with claim 10, wherein the impedance of said first nozzle is equal to the impedance of said second nozzle, and the impedance of said first ink inlet is greater than the impedance of said second ink inlet.

13. A recording method in accordance with claim 12, wherein each of said first and second ink inlets has a cross-sectional area perpendicular to a direction of ink flow, and wherein the cross-sectional area of said first ink inlet is smaller than the cross-sectional area of said second ink inlet.

14. A recording method in accordance with claim 12, wherein a length of said first ink inlet in a direction of ink flow is longer than a length of said second ink inlet in a direction of ink flow.

15. An inkjet recording head in accordance with claim 3, wherein said first ratio of the impedance of said first ink inlet to the impedance of said first nozzle is near 0.5 and said second ratio of the impedance of said second ink inlet to the impedance of said second nozzle is near 6.0.

16. An inkjet recording head in accordance with claim 4, wherein said first ratio of the impedance of said first ink inlet to the impedance of said first nozzle is near 1.0 and said second ratio of the impedance of said second ink inlet to the impedance of said second nozzle is near 5.0.

17. A recording method in accordance with claim 10, wherein said first ratio of the impedance of said first ink inlet to the impedance of said first nozzle is near 0.5 and said second ratio of the impedance of said second ink inlet to the impedance of said second nozzle is near 6.0.

18. A recording method in accordance with claim 11, wherein said first ratio of the impedance of said first ink inlet to the impedance of said first nozzle is near 1.0 and said second ratio of the impedance of said second ink inlet to the impedance of said second nozzle is near 5.0.

* * * * *

UNITED STATES PATENT AND TRADEMARK OFFICE

CERTIFICATE OF CORRECTION

PATENT NO. : 6,059,395
DATED : May 9, 2000
INVENTOR(S) : Hisashi Takata et al.

It is certified that error appears in the above-identified patent and that said Letters Patent is hereby corrected as shown below:

Title page,
Item [75], Inventors, delete "Hasashi Takata,", and insert -- Hisashi Takata, --.

Column 7,
Line 12, delete "both of said first and second ratios are", and insert -- said first ratio is in a range from greater than 3.0 up to 6.0 and said second ratio is --.
Line 15, delete "both of said first and second ratios are", and insert -- said first ratio is in a range from greater than 3.0 up to 5.0, and said second ratio is --.

Column 8,
Lines 11-12, delete "and both of said first and second ratios are" and insert -- said first ratio is in a range from greater than 3.0 up to 6.0 and said second ratio is --.
Line 15, delete "both of said first and second ratios are", and insert -- said first ratio is in a range from greater than 3.0 up to 6.0 and said second ratio is --."
Line 34, delete "0.5", and insert -- 6.0 --.
Lines 36 and 46, delete "6.0", and insert -- 0.5 --.
Lines 39 and 49, delete "1.0", and insert -- 5.0 --.
Lines 41 and 51, delete "5.0", and insert -- 1.0 --.
Line 44, delete "0.5", and insert -- 6.0 --.

Signed and Sealed this

Eighth Day of April, 2003

JAMES E. ROGAN
*Director of the United States Patent and Trademark Office*